US005934917A

United States Patent [19]

Haut

[11] Patent Number: 5,934,917

[45] Date of Patent: Aug. 10, 1999

[54] FLUSH/RECESSABLE JUNCTION DEVICE

[76] Inventor: David Haut, 21 Brookside Dr., Gladstone, N.J. 07934

[21] Appl. No.: 09/145,730

[22] Filed: Sep. 2, 1998

Related U.S. Application Data

[63] Continuation-in-part of application No. 08/957,663, Oct. 24, 1997, abandoned.

[51] Int. Cl.[6] ..... H01R 13/44

[52] U.S. Cl. ..... 439/131; 174/57

[58] Field of Search ..... 439/131, 140, 439/145, 344, 345, 352, 535; 174/57

[56] References Cited

U.S. PATENT DOCUMENTS

| | | | |
|---|---|---|---|
| 949,123 | 2/1910 | Klein | 439/140 |
| 1,160,187 | 11/1915 | Meschenmoser | 439/535 |
| 1,171,914 | 2/1916 | Wright | 439/140 |
| 1,219,908 | 3/1917 | Both | 439/140 |
| 1,328,224 | 1/1920 | Benjamin | 439/140 |
| 2,196,842 | 4/1940 | Strazzabosco | 439/131 |
| 3,197,598 | 7/1965 | Andersen et al. | 439/345 |
| 3,972,579 | 8/1976 | Kohaut | 439/131 |
| 4,059,327 | 11/1977 | Vann | 439/535 |
| 4,361,375 | 11/1982 | Bailey et al. | 439/357 |
| 4,493,517 | 1/1985 | Hillary | 439/145 |
| 4,551,577 | 11/1985 | Byrne | 174/57 |
| 4,984,982 | 1/1991 | Brownlie et al. | 439/131 |
| 4,993,970 | 2/1991 | Littrell | 439/535 |
| 5,574,256 | 11/1996 | Cottone | 174/53 |

*Primary Examiner*—Neil Abrams
*Assistant Examiner*—T C Patel
*Attorney, Agent, or Firm*—Lerner, David, Littenberg, Krumholz & Mentlik, LLP

[57] ABSTRACT

A coupling part is carried by a junction device housing for movement between a position wherein a face surface of the coupling part is flush (co-planar) with a face surface of the junction device housing and a position wherein the coupling part is recessed within the housing. A lift and latch mechanism urges the coupling part to its flush disposition and serves to latch the coupling part in the recessed disposition. In an alternative embodiment a latch mechanism which includes a finger is slidably carried by the housing for movement with respect to the housing to insert an end of the finger into a first or a second notch in the coupling part to latch the coupling part in either its flush or the recessed disposition.

21 Claims, 5 Drawing Sheets

FLUSH/RECESSABLE JUNCTION DEVICE

CROSS-REFERENCE TO RELATED APPLICATIONS

This application is a continuation-in-part of U.S. Ser. No. 08/957,663 filed Oct. 24, 1997, now abandoned, the disclosure of which is hereby incorporated by reference herein.

BACKGROUND OF THE INVENTION—FIELD OF APPLICATION

This invention relates to junction devices which facilitate the interconnection of male and female type connectors, for connecting electrical power, communication and/or other service(s) to equipment requiring such service(s), and more particularly to such junction devices which are mounted within or are carried by a structure such as a wall, article of furniture, piece of a computer or other equipment, fixture, housing or the like.

BACKGROUND OF THE INVENTION—DESCRIPTION OF THE PRIOR ART

Many types of equipment carry part of a coupling which enables connection with and disconnection from a source of supply of "service(s)" required to facilitate operation of the equipment. Such services may include: electricity for power required to operate home appliances, office and industrial equipment and the like; telephone and similar lines for incorporation of equipment and/or internal communication networks; cable and twin-lead lines for connection of receiving equipment to antennas and computer equipment peripherals and the like. The source of the service(s) may either be located within the place of use (such as a home, office, or business) as, for example, a central server or similar equipment for a computer network or other computer accessories, or it may be remote from the place of use (such as a generating station for electricity). Such service(s) are quite often distributed within the place of use by internal conduit (such as wiring, coax cable or the like) which terminate at one or more junction devices each equipped with another part of a coupling device constructed to mate with the part of the coupling device carried by the equipment.

If the service is power electricity the equipment will usually carry a length of electric cord or cable terminating in a male plug to be mated with a female receptacle located in a junction device in a wall or floor, or carried by a desk or other article of furniture, fixture, or equipment. Communication equipment (such as a telephone) will usually include a line terminating in a modular phone-type connector for mating engagement with a modular jack; while coaxial cable and twin-lead, in turn, may be fitted with male bayonet-type connectors for mating engagement with respective female type connections located in a junction device. Connections for computers to other computers in a network and/or to peripheral equipment such as printers, scanners, CD readers, etc. also use communication type electrical lines with mating male and female couplings and connectors.

It is highly desirable to have ready access to the respective coupling parts when effecting a connection therebetween. The part carried by the equipment is usually the male part and is most often disposed at the end of a length of conduit or conductor. The female part, however, is quite often positioned in a junction device disposed proximate a wall or other surface. The male and female coupling parts may be reversed, however, with the equipment carried part usually disposed at the end of a length of conduit and the mating part usually disposed to be flush to a surface at a junction device that facilitates disposition of that part at its location.

Interconnection of the mating coupling parts is, of course, facilitated by the length of conduit or conductor carried by the equipment and by the relatively fixed disposition of the other mating part of the coupling. However, once coupled and disposed proximate the carrying surface, the mated coupling parts often form an obstruction which interferes with disposition of the equipment, or the unit upon which the equipment is disposed, proximate the surface (walls, other unit of equipment) where the relatively fixed coupling part is disposed. Spacing of the equipment from such surfaces may prove undesirable because the equipment may project into a pathway and/or because things may fall between the equipment and the surface carrying the junction device. Alternatively, while recessing the mating coupling within a junction device may facilitate disposition of the equipment (and/or its base) proximate a surface, it may also make access to a coupling, disposed in a relatively confined space and recessed space, relatively difficult when connecting and disconnecting such a coupling.

B. Strazzabosco in U.S. Pat. No. 2,196,842 patented on Apr. 9, 1940 for "Wall Socket" shows, by way of example, a junction box for electrical service where not only the male plug is unacceptably disposed to end out from the mounting surface but also the female receptacle may extend out from the junction surface. U.S. Pat. No. 949,123 patented to C. J. Klein on Feb. 15, 1910 for "Electric Switch" and U.S. Pat. No. 1,171,914 patented to G. Wright on Feb. 15, 1916 for "Receptacle and Plug," on the other hand, provide junction boxes for electric service wherein spring biased closures are provided. However, the internal electrical couplings are fixedly disposed and the mating equipment carried plugs project outwardly from the junction device mounting surface possibly requiring an undesirable spacing of equipment from such mounting surface.

W. F. Meschenmoser, in U.S. Pat. No. 1,160,187 patented on Nov. 16, 1915 for "Plug Receptacle Box for Electric Circuits" and T.A.C. Both in U.S. Pat. No. 1,219,908 patented on Mar. 20, 1917 for "Universal Flush Receptacle and Plug" both provide electric service junction devices wherein the male plug-type coupling carried by the equipment, after being coupled, is disposed in a relatively confined, relatively difficult to access space and may be so disposed behind a door. Any required uncoupling becomes relatively difficult and might render such junction devices unacceptable.

Junction devices with recessed coupling parts are provided U.S. Pat. No. 4,059,327 patented on Nov. 22, 1977 to D. S. Vann for "Recessed Electrical Outlet" and in U.S. Pat. No. 5,574,256 patented on Nov. 12, 1966 to T. E. Cottone for "Recessed Transformer Electrical Outlet Box With Integral Telephone Line Connection." Here again, the coupling part carried by the junction device is fixedly disposed within a relatively confined space which could be unacceptable when effecting a connection and disconnection of the coupling parts.

J. E. Kohaut in U.S. Pat. No. 3,972,579 patented on Aug. 3, 1976 for "Electrical Insert Device" and N. R. Byrne in U.S. Pat. No. 4,551,577 patented on Nov. 5, 1985 for "Retractable Power Center" each provide electric service junction devices which are moved between relatively accessible and relatively enclosed dispositions. However, the relatively complex structures required to so move the junction devices may render such devices unacceptable.

SUMMARY OF THE INVENTION

It is therefore an object of this invention to provide new and novel junction devices.

It is another object of this invention to provide new and novel electric service junction boxes.

It is still another object of this invention to provide new and novel service coupling junction devices which dispose their respective coupling parts in either a disposition relatively flush with a surface to which the device is mounted or relatively recessed with respect to such surface.

It is still another object of this invention to provide new and novel junction coupling devices which may position their respective coupling part either flush with respect to a predetermined surface or recessed with respect to a predetermined surface.

It is yet another object of this invention to provide new and novel service coupling junction devices wherein the device carried coupling part may be latched in either a disposition proximate to, and relatively flush with respect to, a predetermined surface of the device or relatively recessed with respect to the surface.

It is yet still another object of this invention to provide new and novel electric service coupling junction devices wherein the coupling is operative to conduct electricity in either a recessed disposition or a flush disposition of the junction device.

To achieve these objects and other objects, in a preferred embodiment, the present invention provides a junction device comprising a housing and at least one coupling part carried by the housing for movement between (i) at first, or flush, disposition wherein a face surface of the coupling part is substantially aligned with and co-planar with a face of the housing; and (ii) a second, or recessed, disposition wherein the face surface of the coupling part is not co-planar with the face of the housing but is, instead, disposed within the housing. The coupling part is sized and configured to be coupled to a complementary coupling part.

Desirably, the coupling part is an electric receptacle connected to a source of electrical service and is in the form of an electric receptacle with a plurality of female electric receptacles. Alternatively, the service handled by the junction device can be a communication service, with the coupling part being a female phone jack or the like.

In another preferred embodiment, the coupling part can carried by a computer or by equipment peripheral to a computer such as a laser printer, scanner, etc. The coupling part can also be configured to be coupled to both power and communication type mating coupling parts.

In one desired embodiment, the junction device includes a lift and latch spring mechanism which is disposed between the coupling device and housing and which in response to touch pressure against the face surface of the coupling part either permits movement of the coupling part from the flush disposition to the recessed disposition or facilitates movement of the coupling part from the recessed disposition to the flush disposition.

The lift and latch mechanism can also include an operator having a stem which extends through a slit in the face of the housing and a finger which extends from the stem toward and for co-action with either a first notch formed in a side surface of the coupling part or a second notch formed in the surface of the coupling part. Desirably, the first notch is disposed in the side surface of the coupling part proximate the face surface thereof and when coacting with the finger serves to latch the coupling part in the recessed disposition thereof and wherein the second notch is disposed in the side surface of the coupling part spaced from the face surface thereof and when coacting with the finger serves to latch the coupling part in the flush disposition thereof.

An accordance with another aspect of the present invention, the junction device includes a safety cover disposed within the housing and movable from a open position allowing access to the coupling device and a closed position covering the coupling device. The safety cover can be retractable into the housing and, preferably, is inaccessible when the coupling device is in the first, or flush, disposition but accessible when the coupling device is in the second, or recessed, disposition.

In yet another preferred aspect of the present invention, the coupling part and housing are provided with complimentary tongue and groove tracking so as to guide the coupling part upon movement from the first, or flush disposition to the second, or recessed, disposition. In this manner, when the coupling part is to be connected to a source of electrical or other service, the coupling part conducts the electrical or other service through the tongue and groove tracking as the coupling part is moved from the first, or flush disposition to the second, or recessed, disposition.

A method of recessing a coupling part is also provided by the present invention. The method includes: providing a junction device comprising a housing and at least one coupling part carried by the housing; locking the coupling part in at first, fixed disposition wherein a face surface of the coupling part is substantially aligned with and co-planar with a face of the housing; inserting a complementary coupling part into the coupling part when the coupling part is in the first, fixed disposition, the complementary coupling part being sized and configured to be coupled to the coupling part; unlocking the coupling part such that the coupling part is movable from the first, fixed disposition; and moving the coupling part to a second, fixed disposition wherein the face surface of the coupling part is not co-planar with the face of the housing but is, instead, disposed within the housing.

Other objects, features and advantages of the invention in details of construction and arrangement and parts will be seen from the above and from the following description of the preferred embodiments when considered with the drawing and from the appended claims.

DESCRIPTION OF THE PREFERRED EMBODIMENTS

Figure 1:
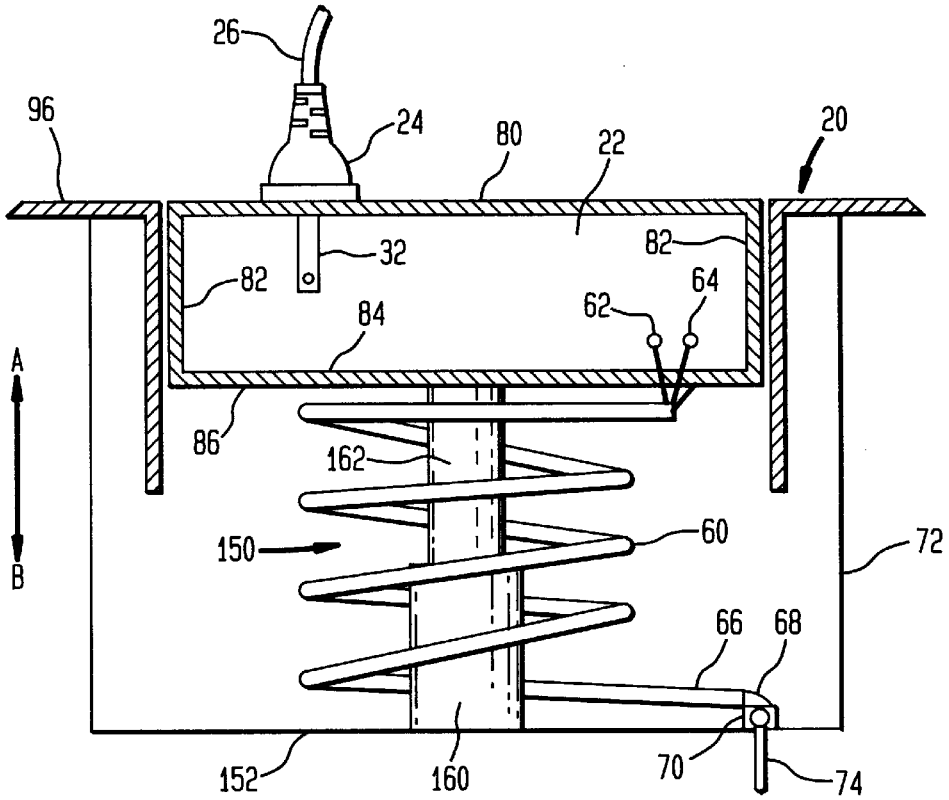
FIG. 1 is an elevation section view of a service junction device, incorporating the instant invention, showing the coupling part in a flush disposition.
Figure 2:
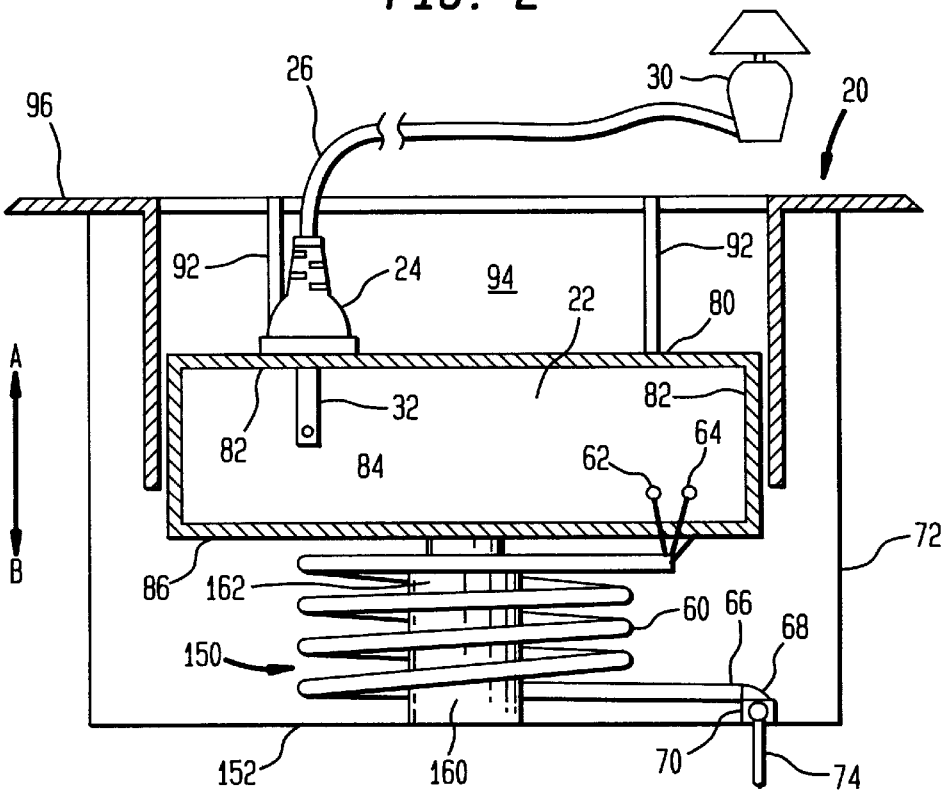
FIG. 2 is an elevation section schematic of the service junction device of FIG. 1 showing the coupling part in its recessed disposition.
Figure 3:
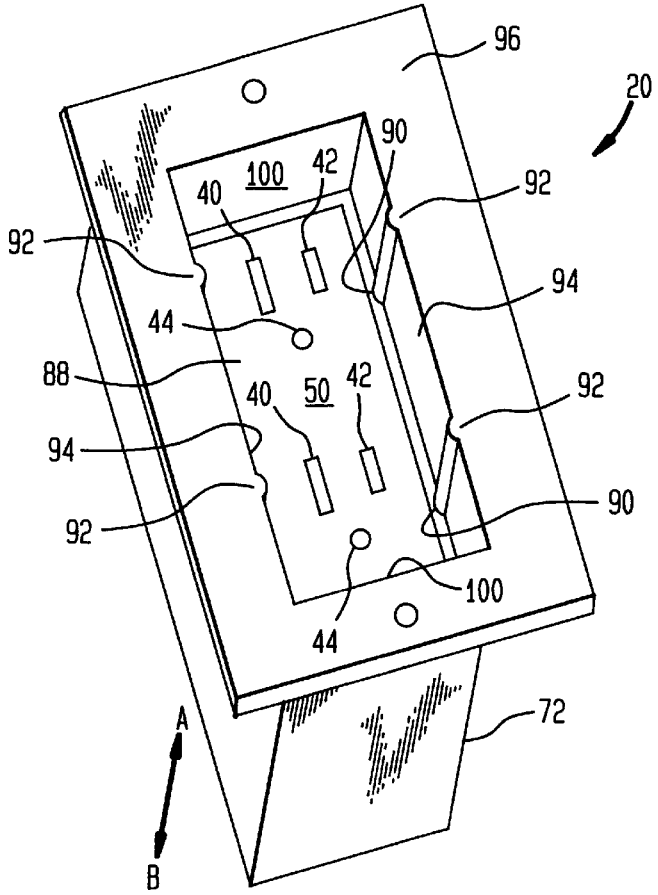
FIG. 3 is a perspective schematic of the service junction device of FIGS. 1 and 2 showing the coupling part in its recessed disposition.
Figure 5:
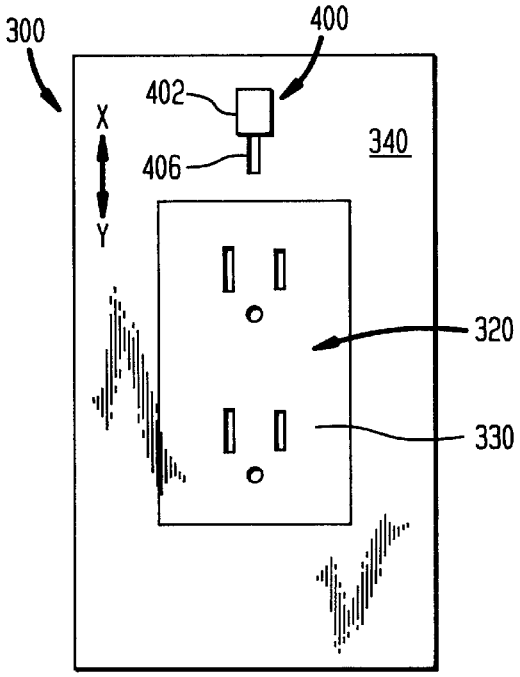
FIG. 5 is a schematic plan view of the service junction device of FIG. 4.

With reference to FIGS. 1, 2 and 3 there is generally shown at 20 a junction device which incorporates the instant invention and which carries, or otherwise has disposed therewithin, a first coupling part 22 disposed to receive and mate with a second coupling part 24 (FIGS. 1 and 2). Conduit 26 (FIG. 2) extends from the second coupling part to an item of utilization equipment 30.

In this particular example of the instant invention junction device 20 is an electrical junction box that receives at its coupling part 22 an electrical female receptacle sized and configured to accept and mate with coupling part 24 which is a male electric plug that incorporates two or more prongs 32 (FIGS. 1 and 2) to be received by electrically conductive elements (not shown) accessed through openings 40, 42, 44 (FIG. 3) formed through a face plate 50 of coupling part 22. An electrical conductor 60 is conventionally connected at 62, 65 (FIGS. 1 and 2) to coupling parts 22 and at 66, 68 to terminal 70 carried by housing 72 of junction device 20.

Electrical conductor 60 may be coiled as shown in FIGS. 1 and 2 or an excess length may be provided therefore to facilitate movement of coupling part 22 in the directions of arrows A and B as will be hereinafter described. A suitable electrical conductor 74 connects terminal 70 to a suitable source of electricity.

An enclosure 80 may be provided for coupling part 22 to provide end walls 82, side walls 84, a bottom wall 86 therefore. A number of grooves 90 (FIG. 3) are formed in outer surfaces of side walls 84 (grooves 90 for only one such side wall 84 being shown) for sliding engagement with ribs 92 that extend out from walls 94 of a device cover 96 into a coupling part space 98 defined between and within walls 94 and cross-connecting walls 100.

A touch latch and lift mechanism 150 (FIGS. 1 and 2) is provided between an outer surface of bottom wall 86 of enclosure 80 and an inner surface of a base wall 152 of housing 72. Mechanism 150 is of conventional construction and may be described as including a guide post 160 extending up from and suitably connected to base wall 152 and which slidably receives a stub shaft 162 that extends down from and is connected to bottom wall 86 of enclosure 80. A mechanism (not shown) coacts with stub shaft 162 to urge shaft 162, enclosure 80 and coupling part 22 in the direction of arrow A until face plate 50 of part 22 aligns and is flush with cover 96 (FIG. 1) (i.e., face plate 50 and cover 96 will be co-planer or substantially coplaner). The application of a reasonable amount of force or pressure to face plate 50 moves coupling part 22 in the direction of arrow B until travel in that direction is limited by the coaction of stub shaft 162 within post 160. Mechanism 150 functions in conventional touch-latch manner so that a subsequent application of a small amount of pressure for a short period against face plate 50 moves part 22 in the direction of arrow B and permits stub shaft 162 to be moved in the direction of arrow A to move part 22 to its flush (FIG. 1) disposition. Other similar mechanisms may be utilized in place of mechanism 150 as long as they produce the same movements for part 22.

Thus it should be seen that when junction device 20 is disposed with its coupling part 22 in its flush (FIG. 1) disposition it is relatively easy to connect another coupling part, such as male plug 24 thereto or to disconnect such other coupling part therefrom. On the other hand once both such coupling parts have been connected coupling part 22 may be moved to and latched into its recessed disposition (FIG. 2) so that the mated coupling parts do not extend out beyond the surface of cover 96 or not unacceptably beyond same.

While junction device 20 has been configured to facilitate coupling of power electrical type parts it may just as well be configured for communication type couplings (such as those utilized for telephone or cable hookups) or for coupling computers to peripheral equipment such as printers, scanners or the like, or to couple radio and television components to antennas or for combinations of power and communication equipment.

Figure 7:
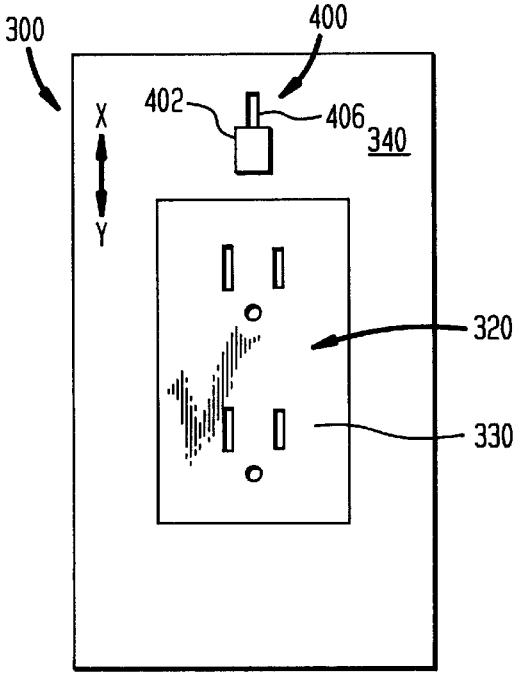
FIG. 7 is a schematic plan view of the junction device of FIG. 6.
Figure 8:
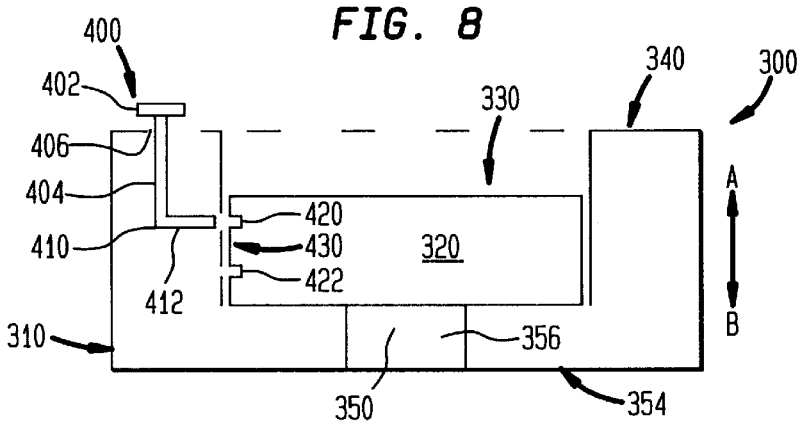
FIG. 8 is an elevation section schematic of the junction device of FIGS. 4–7 but showing the coupling part in a recessed and unlatched disposition.
Figure 9:
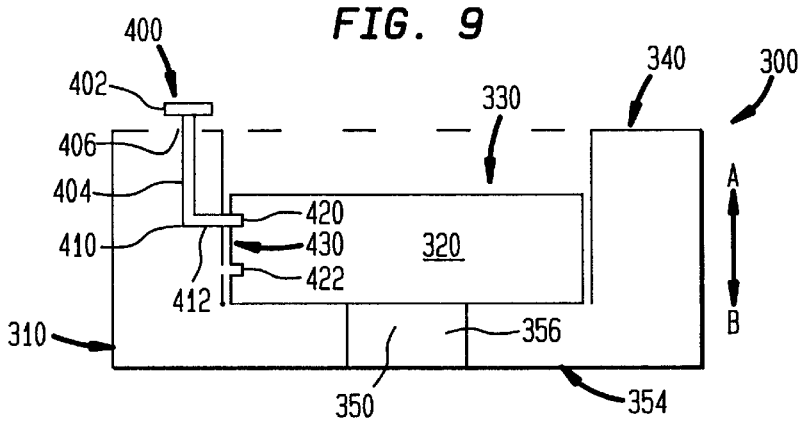
FIG. 9 is an elevation section schematic of the junction device of FIGS. 4–7 but showing the coupling part in a recessed and latched disposition.

An alternative embodiment of junction device 300, also incorporating the instant invention, is shown in FIGS. 4–9. Device 300, like junction device 20 of FIGS. 1–3, also includes a housing 310 (FIGS. 4, 6, 8 and 9), similar to housing 72 (FIGS. 1–3), within which a junction service coupling part 320 (FIGS. 4–9) is disposed for movement between a flush disposition (FIGS. 4 and 6) and a recessed disposition (FIGS. 8 and 9).

In the flush disposition for device 300 (FIGS. 4 and 6) a front face 330 of its coupling part 320 is disposed flush (i.e., in the same plane or substantially the same plane) as a front face 340 of housing 310, while in the recessed disposition thereof (FIGS. 8 and 9) coupling part 320 has been moved in the direction of arrow B (FIGS. 4, 6, 8 and 9), by the application of suitable force in the appropriate direction, to assume the recessed disposition for coupling part 320. All of the above takes place as shown and described above for device 20 and through mechanisms as described above for device 20.

Figure 4:
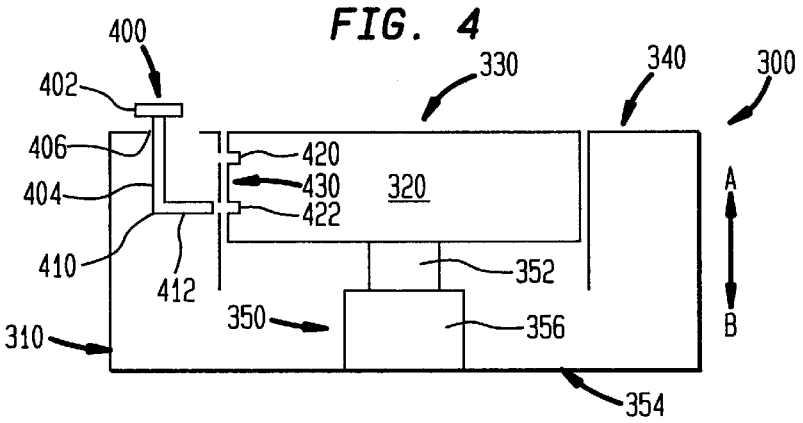
FIG. 4 is an elevation section schematic of an alternative embodiment of the service junction device, incorporating the instant invention, showing the coupling part in a flush and unlatched disposition.

Device 300 may, however, be provided with either an alternative construction of lift and lower assembly 350 or it may also utilize the lift and latch assembly 150 of device 20. A post 352 (FIGS. 4 and 6) of assembly 350, is secured to the bottom wall of coupling part 320 and so as to be received within the hollow of a tubular stub shaft 356 which extends up from a based 354 of housing 310. A suitable coil spring mechanism (not shown) is housed between stub shaft 356 and post 352 and urges coupling part 320 to its flush disposition (FIGS. 4 and 6).

A latch mechanism 400 is slidably carried by housing 310 and includes a latch operator 402 with a stem 404 (FIGS. 4, 6, 8 and 9) that extends down from operator 402 through a slit 406 provided through the face of cover 340 of housing 310 to terminate in a finger 410 having a distal end 412 that extends out towards coupling part 320. A pair of spaced indentations or notches 420, 422 are provided in a side wall 430 of coupling part 320 each sized, disposed and configured to receive distal end 412 of finger 410.

Figure 6:
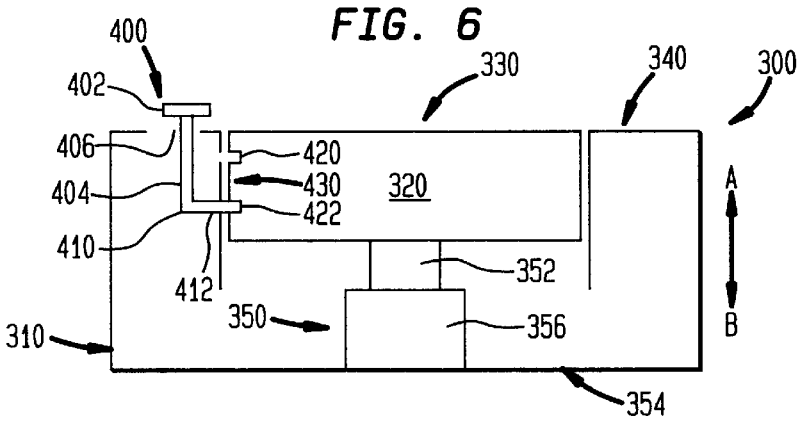
FIG. 6 is an elevation section schematic of the junction device of FIGS. 4 and 5 but showing the coupling part latched.

When coupling device 320 is in its flush disposition operator 400 may be moved in the direction of arrow "Y" (FIGS. 5 and 7) sliding its stem 404 in slit 406 until distal end 412 of finger 410 enters lower notch 422 (FIG. 6) and latches coupling part 320 in its flush disposition (FIGS. 6 and 7). Prior to moving coupling part 320 from its flush disposition to its recessed disposition (FIGS. 8 and 9) operator 402 is moved in the direction of arrow X (FIGS. 5 and 7) moving its stem 404 in slit 406 until distal end 412 of finger 410 moves out of notch 422 and away from coupling part 320, which is thereafter free to be moved to its recessed disposition.

The application of suitable pressure to face 330 of coupling part 320 moves coupling part 320 in the direction of arrow B (FIGS. 4, 6, 8 and 9) from its flush disposition (FIGS. 4 and 6) to its recessed disposition (FIGS. 8 and 9) against the action of the spring mechanism (not shown) for mechanism 350. When part 320 is in its recessed disposition operator 400 can be again slid in the direction of arrow Y (FIGS. 5 and 7) to place end 412 of finger 410 in upper notch 420 of coupling part 320 to latch coupling part 320 in its recessed disposition (FIGS. 7 and 9). Subsequent movement of operator 400 in the direction of arrow X (FIGS. 5 and 9) will move end 412 of finger 410 out of notch 420 and permit the action of lower and lift mechanism 350 to lift coupling part 320 back into its flush disposition where it may be latched by operation of operator 400 as described above.

If desired a latch mechanism, similar to or the same as latch mechanism 400, may also be provided for junction device 20 of FIGS. 1 to 3 along with touch latch 150.

Coupling device 320 is again shown as an electrical receptacle as described above for part 22 but it may just as well be a coupling part configured for other purposes also as described above for coupling part 22 of the junction device of FIGS. 1–3.

Junction devices 20 and 300 have been shown and described as sized and configured to receive a single coupling part. Such devices may just as well be sized and configured to receive more than a single coupling part. Moreover, while the coupling parts have been shown and described to be coupled with a single mating coupling part they may just as well be configured to receive and be coupled with more than one mating coupling part; which coupling parts may be configured for power and/or communication and/or combinations of same.

Figure 10:
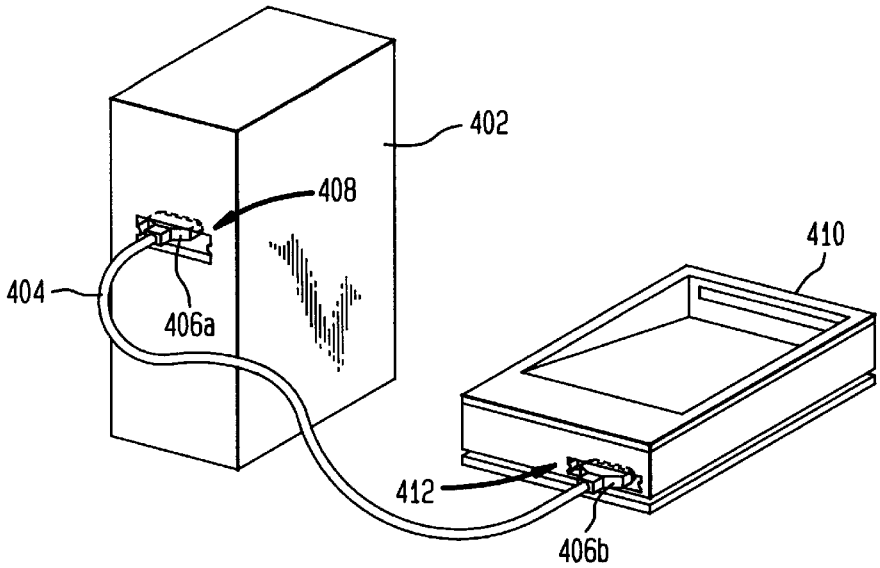
FIG. 10 is a perspective schematic view of computer equipment incorporating the instant invention showing the coupling part in flush dispositions.

As explained above, while junction devices 20 and 300 in one preferred aspect have been configured to facilitate the coupling of power electrical type parts, the junction device of present invention can also be configured for computer and communications type couplings. For instance, as shown in FIG. 10, a computer housing or tower 402 is provided to which computer cables are attached such as printer cable 404. Printer cable 404 includes at one end a connector 406*a* which is adapted to connect to the parallel data port provided by the computer tower 404. In accordance with the present invention, a first junction device 408 is provided which carries the data port with the above-described recessable coupling mechanisms of FIGS. 1 and/or 4. Likewise, the other end 406*b* of printer cable 404 is adapted to connect to the parallel data port of printer 410. Printer 410 thus provides a first junction device 412 which carries the data port with the above-described recessable coupling mechanisms of FIGS. 1 and/or 4. Of course, while only a single junction device is shown for the computer tower and laser printer in FIG. 10, additional junction devices can be provided to handle other computer and peripheral ports such as serial ports, network interface ports, speaker connections, video ports, I/O ports for keyboards, mice, trackballs, etc. Furthermore, multiple couplings can be combined on a single recessable coupling part or separate coupling parts can be provided.

Figure 11:
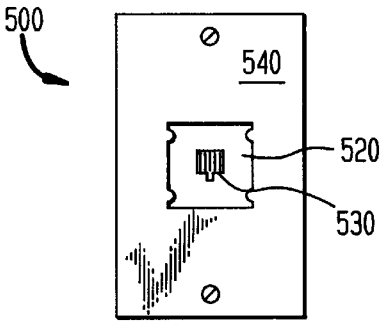
FIG. 11 is a front view of an alternate junction device incorporating the present invention.

FIG. 11 shows another preferred embodiment of the present invention whereby junction device 500 is provided with coupling part 520 which carries a telephone jack receptacle 530, and, in this case a female telephone jack. Such jack could include, for example, an RJ-11 jack connector used to connect telephone equipment and to connect some types of local-area networks (LANs), or an RJ-45 connector which are more common LAN jacks. Again, coupling part 520 is recessable with respect to front face 540 by use of the above-described recessable coupling mechanisms of FIGS. 1 and/or 4.

Figure 12:
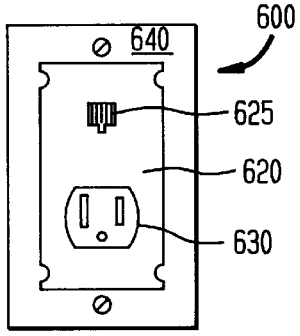
FIG. 12 is a front view of another alternate junction device incorporating the present invention.

FIG. 12 shows yet another preferred embodiment of the present invention whereby junction device 600 is provided with coupling part 620 which carries both a telephone jack receptacle 625 and electrical wall outlet 630, which configuration can be useful with a telephone answering machine, cordless telephone or the like that needs both electrical and telephone line connections. Thus, with the present invention, different couplings for different connectors can be used and provided on the same coupling part for recessability. Again, coupling part 620 is recessable with respect to front face 640 by use of the above-described recessable coupling mechanisms of FIGS. 1 and/or 4.

Figure 13:
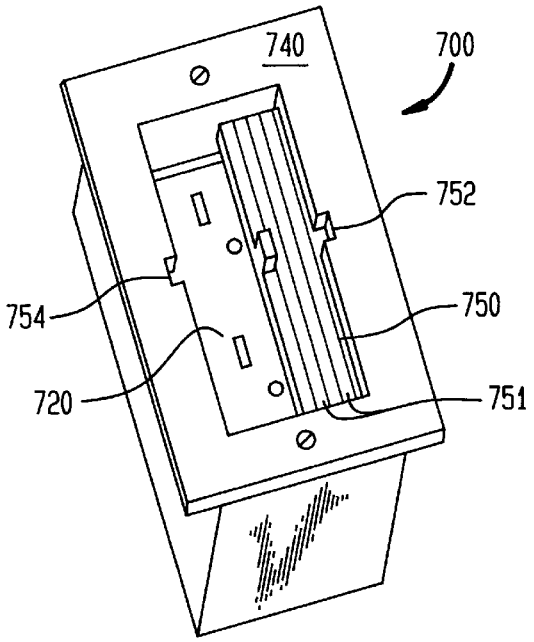
FIG. 13 is a perspective schematic view of a junction device incorporating the present invention with a child safety cover.

Tuning to FIG. 13, yet another preferred embodiment of the present invention provides a child-proofing or safety feature to prevent access to the receptacle. Namely, junction device 700, which includes coupling part 720 and front face 740, is provided with a safety cover 750 which is adapted to be closed over the coupling part once it is moved to the recessed position. To this end, press-fit recess 752 is provided to keep the safety cover 750 in the open position while press-fit recess 754 is provided to allow the cover to be kept in a closed position. Of course, other types of latching mechanisms can be used instead of press-fit recesses so long as the safety cover, when closed, is kept closed such that it can not be accidentally opened or accessed by a small child.

Preferably, safety cover 750 is formed from a series of parallel slats 751 similar to a roll-top desk so that it can roll or recess down into junction device 740 when in the open position. Alternatively, safety cover 750 can be formed from a solid sheet and be flexible enough to bend around the corner and recess into junction device 740. Of course, many other arrangements of safety covers can be provided such that the safety cover can be closed once the coupling part is recessed, such as the cover being nonflexible and movable off to the side in parallel to face 740. One notable advantage of the present invention is that the safety cover can be hidden when the coupling part is in its flush position for aesthetics and then become accessible after the coupling part is moved to its recessed position.

Figure 14:
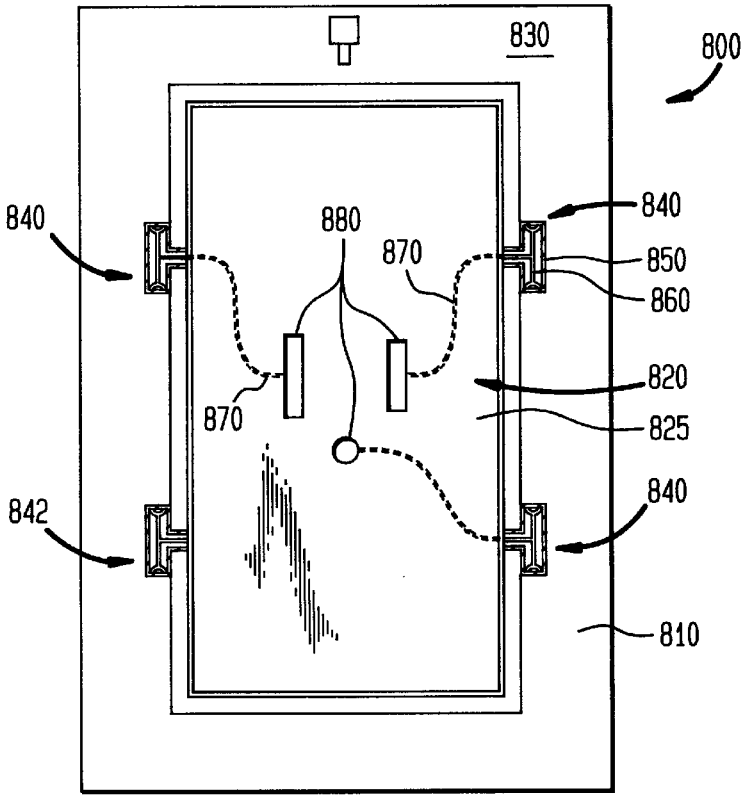
FIG. 14 is a schematic plan view of a service junction device, incorporating another preferred aspect of the instant invention.
Figure 15:
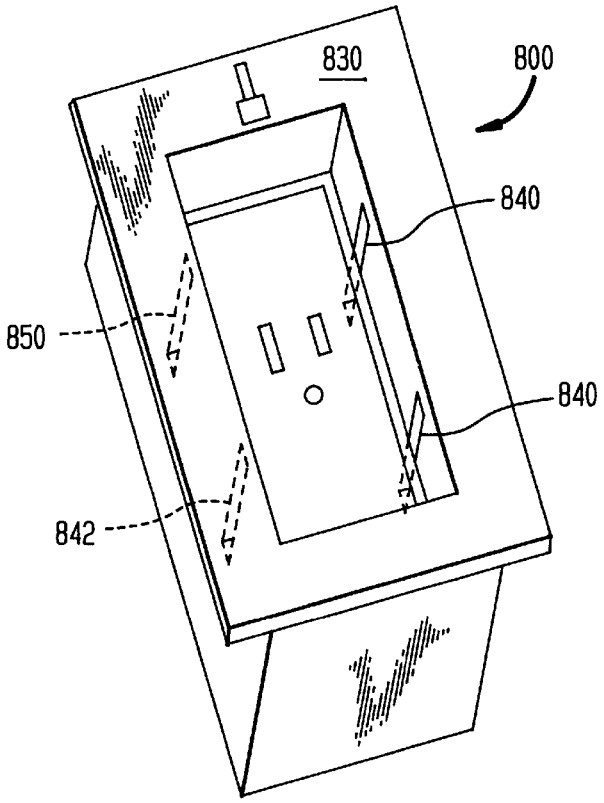
FIG. 15 is a perspective schematic of the service junction device of FIG. 14 showing the coupling part in its recessed disposition.

Finally, turning to FIGS. 14 and 15, there is shown another preferred embodiment of the present invention whereby the coupling part is moveable within a number of tracks. Namely, as in FIGS. 1, 2 and 3 there is generally shown a junction device 800 with housing 810 and face plate 830, which incorporates the instant invention and which carries first coupling part 820 disposed to receive and mate with a second coupling part connected to utilization equipment. In this particular example of the instant invention, junction device 800 is an electrical junction box that receives at its coupling part 820 an electrical female receptacle sized and configured to accept and mate with coupling part which is a male electric plug that incorporates two or more prongs (as shown in FIGS. 1 and 2) to be received by electrically conductive elements accessed through openings 880 formed through face plate 825 of coupling part 820. Electrical conductors 870 are provided which carry electricity to tracks 840 disposed in housing 810 which consist of track housings 850. Each track housing 850 is constructed in a tongue and groove arrangement to carry slidable tongues 860 which fit and move within track housings 850. Thus, movement of the coupling 820 from the flush to the recessed position will cause the tongues 860 to slide within track housings 850 while still maintaining electrical contact.

Advantageously, the tracks 840 also provide stability to the recessed position in the same manner that the grooves 90 and ribs 92 provide stability to the junction device of FIG. 3. To this end, an additional track 842 is provided to add stability even though it is not electrically connected in the outlet. Of course, only one type of track is shown and other types of track arrangements can be provided such that the coupling part maintains electrical contact when moved between the flush and recessed positions. Furthermore, multiple electrical outlets could be provided on the same coupling with the same amount or additional tracks. Additionally, the tracks could be located on the coupling part 820 rather than in the housing 810 or in both.

From the above description it will thus be seen that there has been shown and described new and novel junction devices which facilitate coupling and decoupling of mating components of coupling parts and further facilitates disposition of such mated coupling parts in either a disposition proximate a surface of the structure carrying the junction device or recessed from that structure surface.

It is understood that although I have shown the preferred embodiments of my invention that various modifications may be made in the details thereof without departing from the spirit as comprehended by the following claims.

What is claimed is:

1. A junction device for connecting with a complementary coupling part comprising:

(a) a housing; and (b) at least one coupling part connectable with a power and/or signal source and being sized and configured to be coupled to the complementary coupling part, said coupling part having a face surface and being carried by said housing for movement between (i) a first, flush disposition wherein said face surface of said coupling part is substantially aligned with and co-planar with a face of said housing, and wherein said coupling part can be coupled to the complementary coupling part so as to conduct power and/or signals to or from the complementary coupling part with said coupling part remaining in said first position; and (ii) a second, recessed disposition wherein said face surface of said coupling part is not co-planar with said face of said housing but is, instead, disposed within said housing and positioned substantially parallel to said face of said housing, and wherein said coupling part can be coupled to the complementary coupling part so as to conduct power and/or signals to or from the complementary coupling part with said coupling part remaining in said second position or can remain in said second disposition without being coupled to the complementary coupling part.

2. The junction device of claim 1 wherein the power and/or signal source is electrical service and said coupling part is configured to be coupled with a plurality of mating coupling parts.

3. The junction device of claim 2 wherein said coupling part is an electric receptacle.

4. The junction device of claim 3 when said electric receptacle includes a plurality of female electric receptacles.

5. The junction device of claim 1 wherein the power and/or signal source is a communication service.

6. The junction device of claim 5 wherein said coupling part is a phone jack.

7. The junction device of claim 6 wherein said coupling part is a female phone jack.

8. The junction device of claim 5 wherein the coupling part is carried by a computer.

9. The junction device of claim 5 wherein the coupling part is carried by equipment peripheral to a computer.

10. The junction device of claim 7 wherein the coupling part is configured to be coupled to both power and communication type mating coupling parts.

11. The junction device of claim 1 including a lift and latch mechanism disposed between said coupling device and said housing and which in response to touch pressure against said face surface of said coupling part either permits movement of said coupling part from said flush disposition to said recessed disposition or facilitates movement of said coupling part from said recessed disposition to said flush disposition.

12. The junction device of claim 11 wherein said lift and latch mechanism includes a spring mechanism.

13. The junction device of claim 12 wherein said lift and latch mechanism includes an operator having a stem which extends through a slit in said face of said housing and a finger which extends from said stem toward and for co-action with either a first notch formed in a side surface of said coupling part or a second notch formed in said surface of said coupling part.

14. The junction box of claim 13 wherein said first notch is disposed in said side surface of said coupling part proximate said face surface thereof and when coacting with said finger serves to latch said coupling part in said recessed disposition thereof and wherein said second notch is disposed in said side surface of said coupling part spaced from said face surface thereof and when coacting with said finger serves to latch said coupling part in said flush disposition thereof.

15. The junction device of claim 1 including a lift and latch mechanism disposed between said coupling device and said housing including an operator having a stem which extends through a slit in said face of said housing and a finger which extends from said stem toward and for co-action with either a first notch formed in a side surface of said coupling part or a second notch formed in said surface of said coupling part.

16. The junction device of claim 1 including a safety cover disposed within said housing and movable from a open position allowing access to said coupling device and a closed position covering said coupling device.

17. The junction device of claim 16 wherein said safety cover is retractable into said housing.

18. The junction device of claim 16 wherein said safety cover is inaccessible when said coupling device is in said first, or flush, disposition but accessible when said coupling device is in said second, or recessed, disposition.

19. The junction device as claimed in claim 1 wherein said coupling part and said housing are provided with complimentary tongue and groove tracking so as to guide said coupling part upon movement from said first, or flush disposition to said second, or recessed, disposition.

20. The junction device as claimed in claim 19, wherein said coupling part, when coupled to the complementary coupling part, conducts the power and/or signals thereto through said tongue and groove tracking when said coupling part is in said first, flush disposition or in said second, recessed disposition.

21. A method of recessing a coupling part in a junction device which connects with a complementary coupling part comprising:

(a) providing a junction device comprising a housing and at least one coupling part connectable with a power and/or signal source and being sized and configured to be coupled to the complementary coupling part, said coupling part having a face surface and being carried by said housing, (b) locking said coupling part in at first, flush disposition wherein said face surface of said coupling part is substantially aligned with and co-planar with a face of said housing, (c) inserting the complementary coupling part into said coupling part when said coupling part is in said first, flush disposition such that said coupling part conducts power and/or signals to or from the complementary coupling part with said coupling part remaining in said first, flush disposition, (d) unlocking said coupling part such that said coupling part is movable from said first, flush disposition, and (e) moving said coupling part to a second, recessed disposition wherein said face surface of said coupling part is not co-planar with said face of said housing but is, instead, disposed within said housing and positioned substantially parallel to said face of said housing, and wherein said coupling part continues to conduct power and/or signals to or from the complementary coupling part.

* * * * *